US007526864B1

(12) United States Patent
Eisner

(10) Patent No.: US 7,526,864 B1
(45) Date of Patent: May 5, 2009

(54) METHOD OF FITTING A RING

(76) Inventor: Carolyn M. Eisner, 750 Driver Rd., Trinidad, CA (US) 95570

( * ) Notice: Subject to any disclaimer, the term of this patent is extended or adjusted under 35 U.S.C. 154(b) by 622 days.

(21) Appl. No.: 10/997,947

(22) Filed: Nov. 29, 2004

(51) Int. Cl.
*A44C 27/00* (2006.01)

(52) U.S. Cl. ..... 29/896.4

(58) Field of Classification Search ..... 29/896.4, 29/896.412, 896.43; 63/15, 15.5, 15.6, 15.7
See application file for complete search history.

(56) References Cited

U.S. PATENT DOCUMENTS 2,532,354 A * 12/1950 Hirsh ..... 63/15.6
3,483,717 A 12/1969 Mayer
4,215,556 A * 8/1980 Mroz ..... 63/15.6
4,480,447 A * 11/1984 Lodrini ..... 63/15.6
4,538,430 A 9/1985 Parks
4,569,211 A * 2/1986 Lodrini ..... 63/15.6
3,362,256 A 1/1993 DeSanto
5,239,842 A * 8/1993 Gesensway ..... 63/15.6
5,261,256 A 11/1993 Ellenbecker et al.
5,628,208 A 5/1997 Rood
5,636,531 A * 6/1997 Miller ..... 63/15.6
5,741,094 A * 4/1998 Heep ..... 406/182
6,192,708 B1 2/2001 Mitchell

* cited by examiner

*Primary Examiner*—John C Hong

(57) ABSTRACT

A method of fitting a ring includes providing an elongate flexible member. The flexible member is formed into a plurality of loops so that a cylinder is defined. Each of the loops has a substantially equal diameter. The loops abut each other. A ring is positioned on a finger and then the winding said flexible member on said ring such that said ring extends through said loops are wound onto the ring so that the ring extends through the loops.

9 Claims, 3 Drawing Sheets

METHOD OF FITTING A RING

BACKGROUND OF THE INVENTION

1. Field of the Invention

The present invention relates to ring sizing devices and more particularly pertains to a new ring sizing device for reducing the size of a ring without permanently removing a section of the ring.

2. Description of the Prior Art

The use of ring sizing devices is known in the prior art. U.S. Pat. No. 6,192,708 describes an arcuate panel that is positionable along an inner surface of a ring to reduce the size of the ring. Another type of ring sizing device is U.S. Pat. No. 5,261,256 which includes a flexible plate that when positioned against an inner surface of ring, prevent the ring from rotating on a finger. U.S. Pat. No. 3,362,189 includes a flexible member having a clamp on one end and a gripping member on the other. The clamp and gripping member are engaged to opposite positions of an inner surface of a ring to reduce the effective diameter thereof. U.S. Pat. No. 2,532,354 includes a coiled ring size that includes rounded ends for the comfort of its user.

While these devices fulfill their respective, particular objectives and requirements, the need remains for a device that is easily positionable on a ring and which will not be readily fall away from the ring. Additionally, the device should be comfortable on the skin of a wearer of a ring as well as being readily camouflaged.

SUMMARY OF THE INVENTION

The present invention meets the needs presented above by generally comprising an elongate flexible member. The flexible member is formed into a plurality of loops so that a cylinder is defined. Each of the loops has a substantially equal diameter. The loops abut each other. A ring is positioned on a finger and then the loops are wound about the ring so that the ring extends through the loops.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
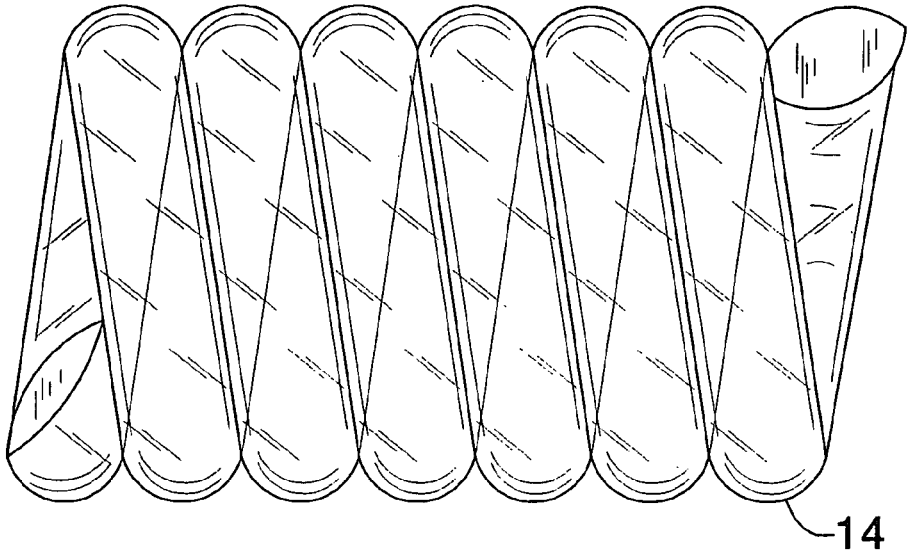
FIG. 1 is a front view of a method of fitting a ring according to the present invention.
Figure 2:
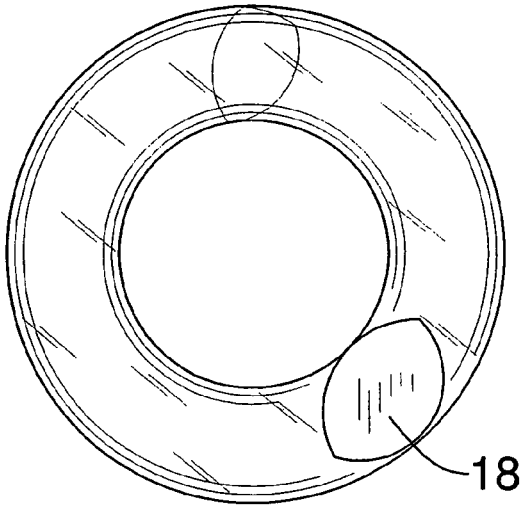
FIG. 2 is a right side view of the present invention.
Figure 3:
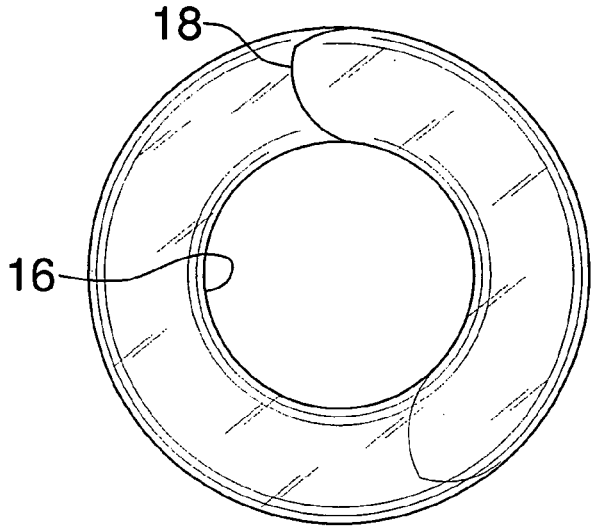
FIG. 3 is a left side view of the present invention.
Figure 4:
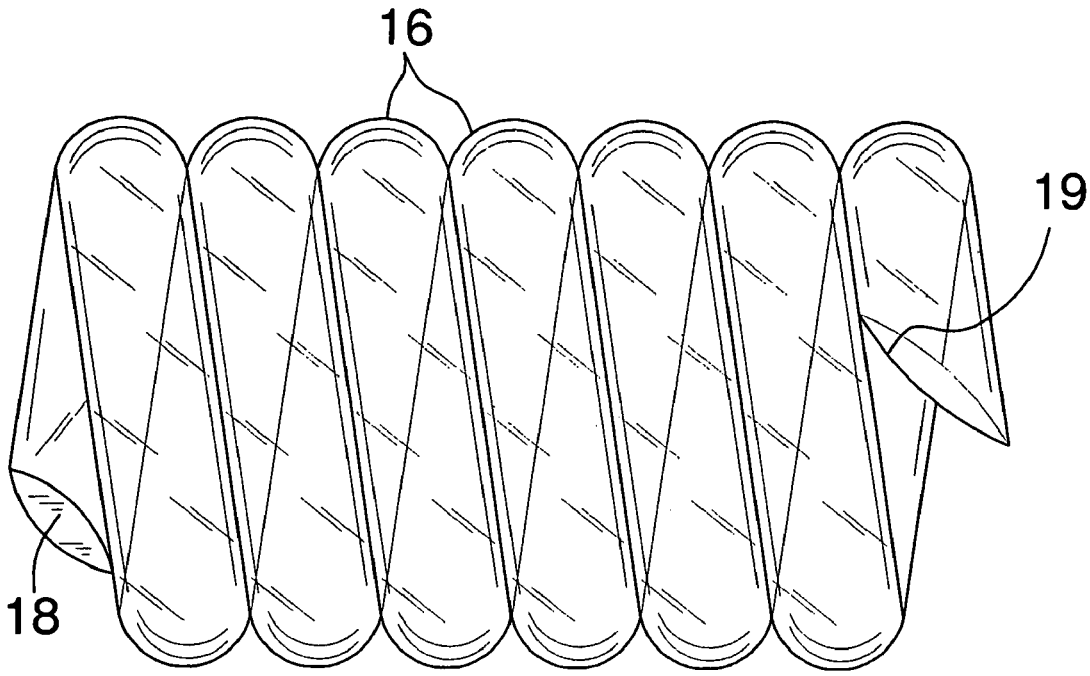
FIG. 4 is a rear view of the present invention.
Figure 5:
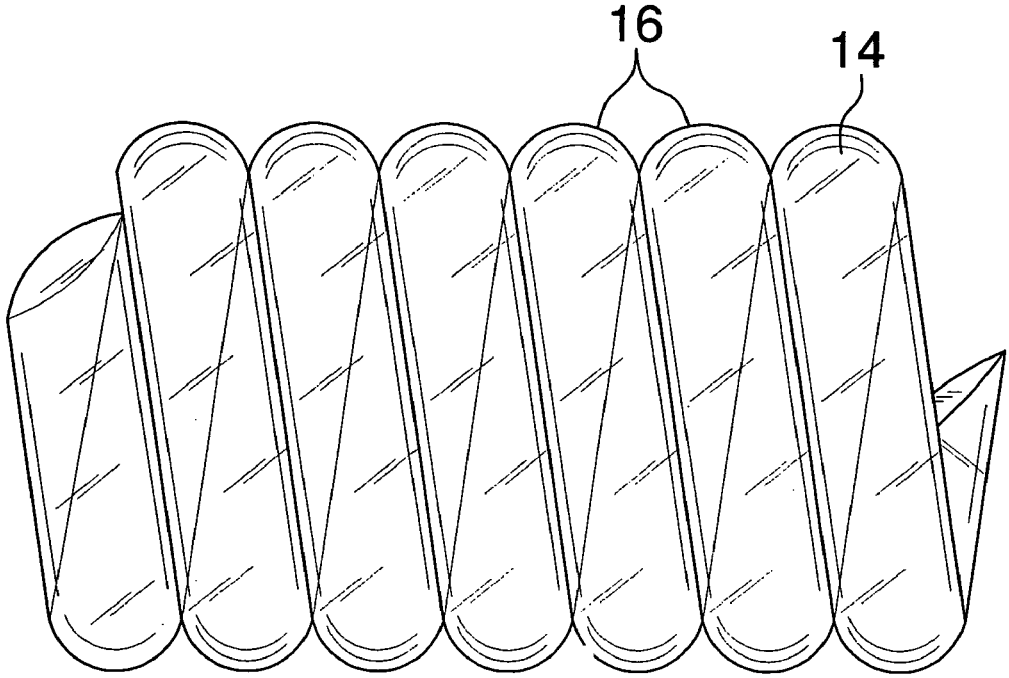
FIG. 5 is a bottom view of the present invention.
Figure 6:
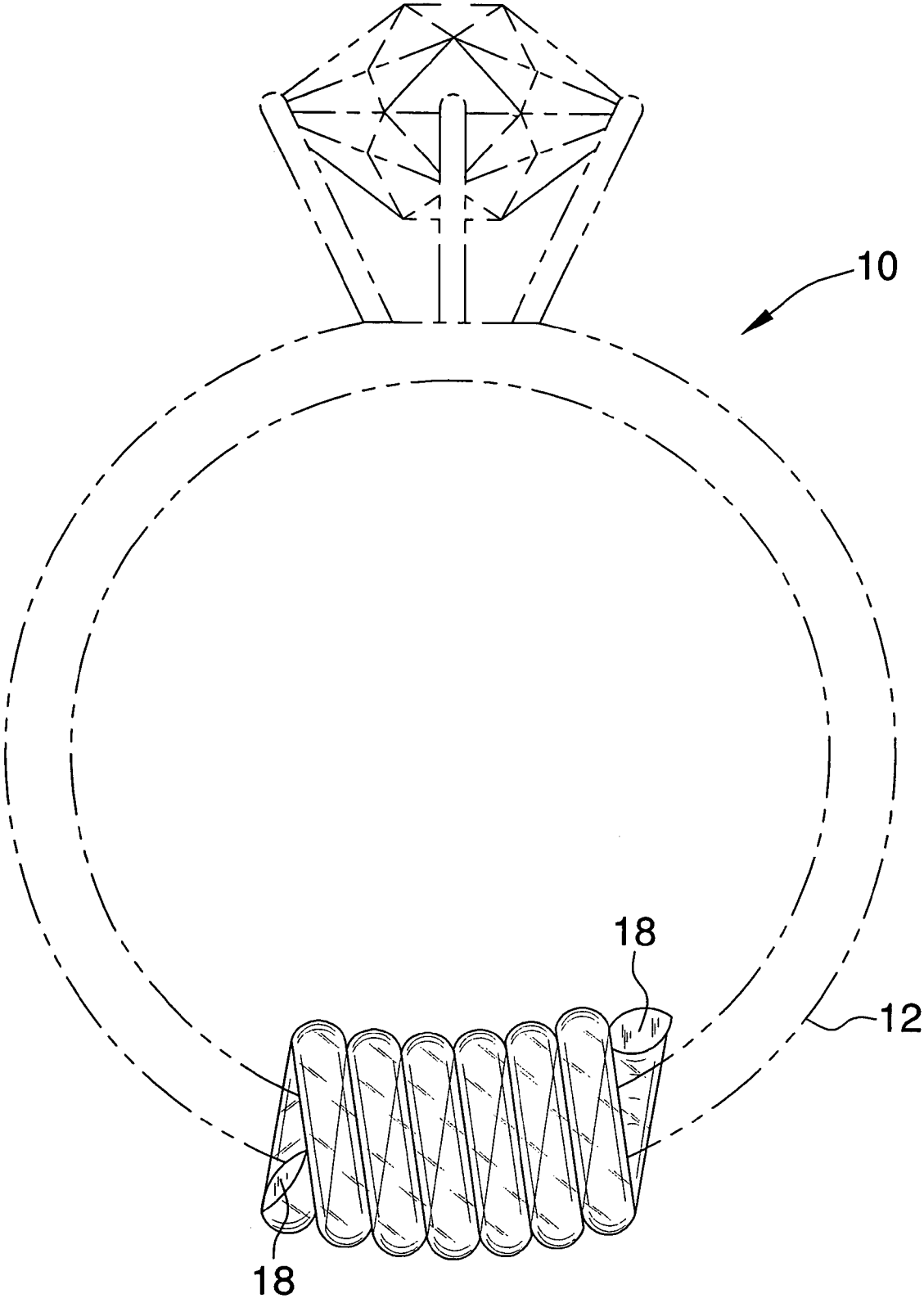
FIG. 6 is a front in-use view of the present invention.

With reference now to the drawings, and in particular to FIGS. 1 through 6 thereof, a new ring sizing device embodying the principles and concepts of the present invention and generally designated by the reference numeral 10 will be described.

As best illustrated in FIGS. 1 through 6, the method of fitting a ring 10 generally includes a conventional ring 12 which is worn on a finger. While rings may have differing widths along their circumference, rings generally have a smallest width along a bottom portion of the ring. For the purposes of this method, it is this smallest width that will be addressed below.

An elongate flexible member 14 is provided that is formed into a plurality of loops 16 so that a cylinder is defined. Each of the loops 16 has a substantially equal diameter and the loops 16 abut each other. The plurality of loops 16 includes at least 5 loops. Each of the loops 16 has an inner diameter that is generally equal to a width of the ring 12 along its bottom portion. The cylinder has a length generally between ⅛ and ⅓ of a circumference of the ring 12. The flexible member 14 comprises a plastic material, which is ideally polyurethane. Preferably, the flexible member 14 is substantially transparent for reasons which will become apparent below. Alternatively, the flexible member 14 may be colored a skin tone color and may also be translucent. The skin tone color will be dependent upon the color of skin of the person wearing the ring 12 and will generally include light to dark skin tones.

The ring 12 is placed on a finger and then the loops are wound through the ring 12 so that the ring extends through the loops. This may be accomplished by extending the ring between a free end 18 of the flexible member 14 and next abutting loop 16 and then moving the ring 12 between all of the loops 16 until the cylinder of loops 16 is positioned on the ring 12. Ideally, each of the free ends 18 of the flexible member is angled. The free ends are each angled in the same direction with respect to each other. This will allow for ease of manufacture while ensuring that at least one of the free ends 18 is angled outwardly away from the next abutting loop 18 and will form a notch 19 for easily winding the loops onto the ring.

In use, as a person loses weight or their fingers shrink due to weather changes or dehydration, a ring 12 they are wearing will become loose. At such a time, the loops 16 are positioned on the ring 12 to reduce the inner diameter of the ring 12 and bias the lower portion of the ring 12 away from the finger. By having plastic which is colored or transparent and loops that abutted together, the loops 16 are camouflaged on the ring 12 and will be generally undetected by casual inspection. The flexible nature of the flexible member 14 also ensures that flexible member 14 will be comfortable against the skin. The ring 12 must be positioned on the finger first before the loops 16 are placed on the ring to allow the ring to move over the knuckles of the finger.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ring diameter reducing method comprising the steps of:

providing a ring positioned on a finger;

providing an elongate flexible member, said flexible member being formed into a plurality of loops such that a cylinder is defined, each of said loops having a substantially equal diameter, said loops abutting each other, said loop having a pair of free ends, each of said free ends being angled in a same direction with respect to each other such that at least one of said free ends and an adjacent one of said loops forms a ring receiving notch, said free ends terminating in a pointed edge; and winding said flexible member on said ring such that said ring extends through said loops.

2. The method according to claim 1, wherein said plurality of loops includes at least 5 loops.

3. The method according to claim 1, wherein each of said loops has an inner diameter being generally equal to a width of said ring.

4. The method according to claim 1, wherein said cylinder has a length generally between ⅛ and ⅓ of a circumference of said ring.

5. The method according to claim 1, wherein said flexible member comprises a plastic material.

6. The method according to claim 5, wherein said plastic material comprises polyurethane.

7. The method according to claim 5, wherein said plastic material is colored a skin tone color.

8. The method according to claim 5, wherein said plastic material is substantially transparent.

9. A ring diameter reducing method comprising the steps of:

providing a ring positioned on a finger;

providing an elongate flexible member, said flexible member being formed into a plurality of loops such that a cylinder is defined, each of said loops having a substantially equal diameter, said loops abutting each other, said plurality of loops including at least 5 loops, each of said loops having an inner diameter being generally equal to a width of said ring, said loop has a pair of free ends, each of said free ends being angled in a same direction with respect to each other such that at least one of said free ends and an adjacent one of said loops forms a ring receiving notch, said cylinder having a length generally between ⅛ and ⅓ of a circumference of said ring, said flexible member comprising a plastic material, said plastic material comprising polyurethane, said plastic material being substantially transparent, said free ends terminating in a pointed edge; and winding said flexible member on said ring such that said ring extends through said loops.

* * * * *